United States Patent [19]

Howard

[11] Patent Number: 4,777,752

[45] Date of Patent: Oct. 18, 1988

[54] BLANK MAGAZINE

[76] Inventor: William J. Howard, P.O. Box 573, Wilson, N.C. 27893

[21] Appl. No.: 59,924

[22] Filed: Jun. 9, 1987

[51] Int. Cl.[4] ..... F41C 25/02

[52] U.S. Cl. ..... 42/50; 42/49.02

[58] Field of Search ..... 42/50, 49.02

[56] References Cited

U.S. PATENT DOCUMENTS

| | | | |
|---|---|---|---|
| 1,407,633 | 2/1922 | Burton | 42/49.02 |
| 2,296,729 | 9/1942 | Mossberg | 42/49.02 |
| 2,840,944 | 7/1958 | Thompson | 42/49.02 |
| 4,139,959 | 2/1979 | Howard et al. | 42/50 |
| 4,413,437 | 11/1983 | Anderson | 42/50 |
| 4,472,900 | 9/1984 | Howard | 42/50 |

*Primary Examiner*—Charles T. Jordan

*Attorney, Agent, or Firm*—David R. Murphy

[57] ABSTRACT

A blank magazine for feeding blank rounds to a bolt-equipped firearm.

The magazine has a back wall and a front wall.

The distance between the inner surface of the back wall and the inner surface of the front wall is less than the length of a standard round but is greater than the length of a blank round.

The magazine also has structure which prevents any standard round from being fed by the bolt of the firearm.

8 Claims, 3 Drawing Sheets

FIG. 1
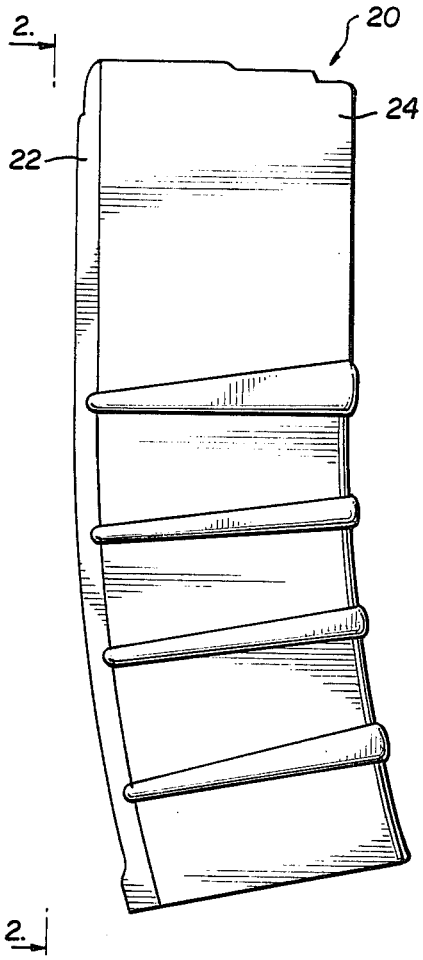
FIG. 2
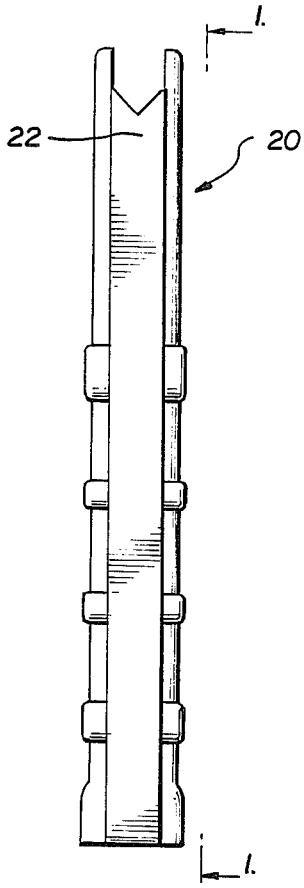
FIG. 3
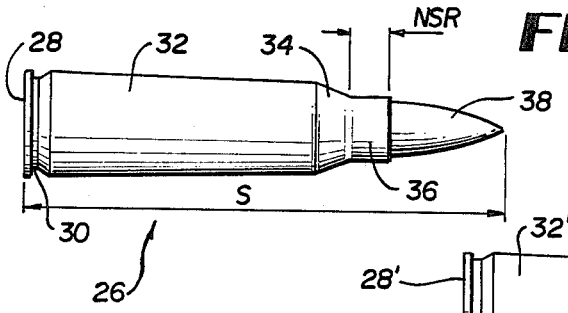
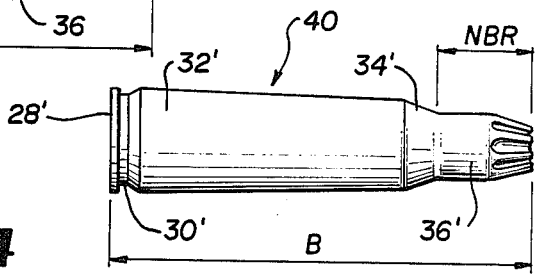
FIG. 4

BLANK MAGAZINE

This invention relates to a blank magazine for feeding blank rounds to a bolt-equipped firearm.

It is common practice to sometimes fire blank rounds from firearms. Blank rounds are fired by military personnel during training exercises to simulate realism. Police and others frequently use blank rounds to disperse crowds and to control riots. Blank rounds are also employed in the production of motion picture films, stage plays and elsewhere in the entertainment industry in order to achieve a realistic affect.

Heretofore, it has been common practice to place blank rounds in standard magazines which are used to hold standard rounds. The term "standard round" means a round equipped with a projectile and a powder charge. Unfortunately, the use of standard magazines is hazardous. These standard magazines can contain one or more standard rounds intermixed with the blank rounds. These standard rounds may be placed in the standard magazine by accident or on purpose. Once a standard round is placed in the magazine, it is usually not visible because the magazine is opaque. Furthermore, it is difficult to see down into a magazine from its open top.

The presence of one or more standard rounds in an opaque magazine having blank rounds on top and visible can lead to injury or death to innocent persons. The person with the firearm looks at the magazine, sees only blank rounds and does not know that the magazine also holds a standard round. The magazine is then placed in the firearm, whereupon firing is commenced. The standard round is fired in the midst of blank rounds. This may result in injury or death to anyone in the line of fire.

It is, therefore, an object of the present invention to provide a blank magazine having a structure different than a standard magazine wherein the blank magazine overcomes one or more of the disadvantages inherent in the use of a standard magazine.

Another object is to provide a blank magazine especially adapted to hold blank cartridges.

Still another object of the present invention is to provide a blank magazine which will not accept a standard round except as the top round wherein it is easily visible.

Still another object of the present invention is to provide a blank magazine, which when improperly fed with a standard round will not permit a bolt to feed this standard round to the chamber of a firearm.

Figure 5:
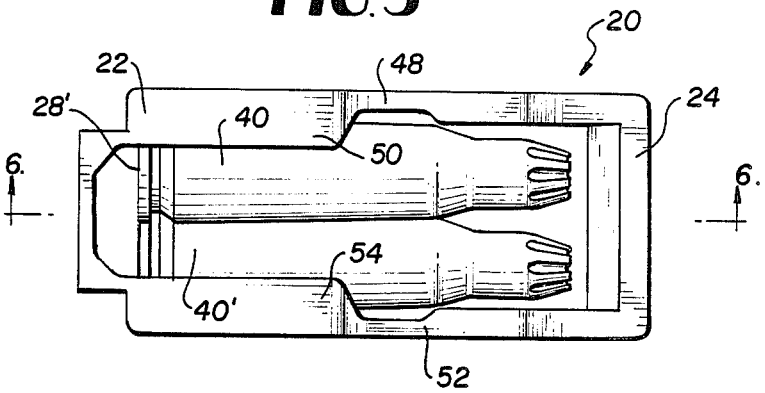
Figure 6:
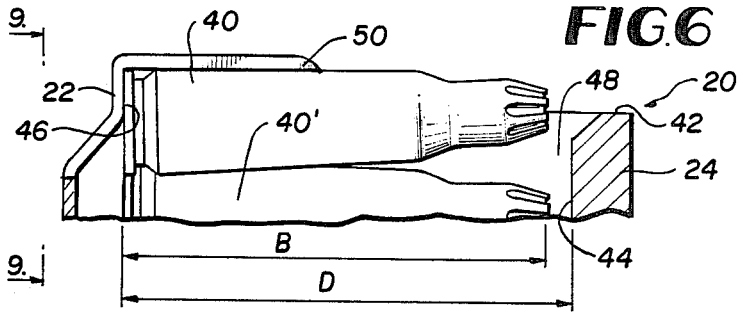
Figure 7:
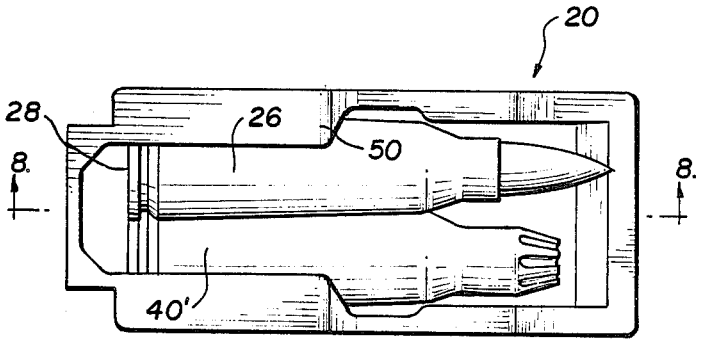
Figure 8:
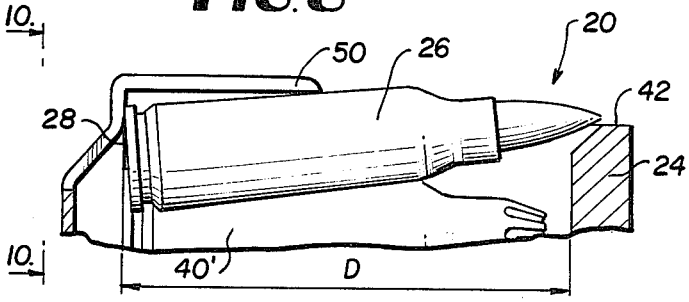
Figure 11:
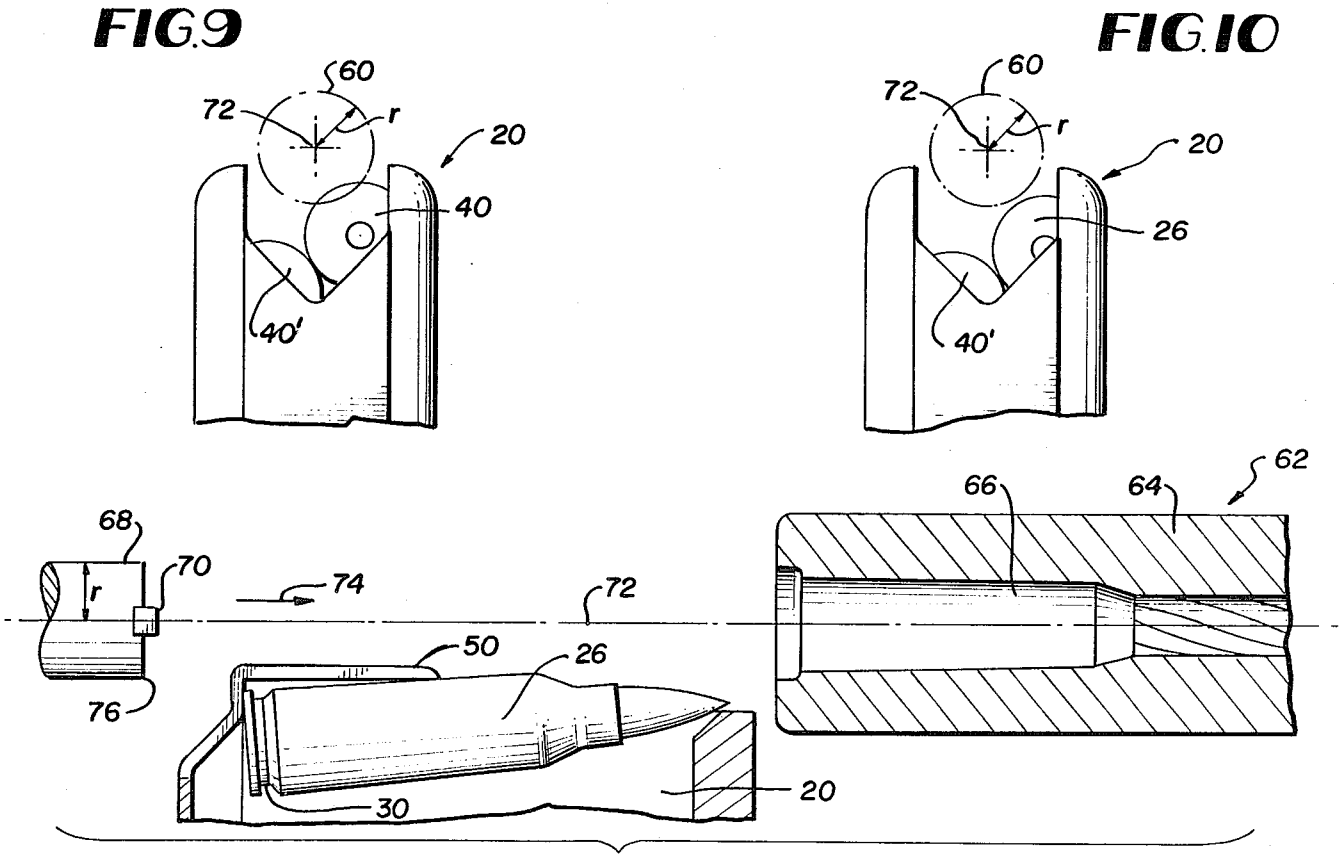

Additional objects and advantages of the present invention will be apparent to those skilled in the art by reference to the following drawings wherein:

FIG. 1 is a side view approximately full-size of a blank magazine of the present invention; and FIG. 2 is an end view taken along Line 2—2, of FIG. 1; and FIG. 3 is a side view of a certain standard round; and FIG. 4 is a side view of a certain blank round; and FIG. 5 is a top view of the blank magazine of the present invention containing a plurality of blank rounds; and FIG. 6 is a sectional view taken along Line 6—6 of FIG. 5; and FIG. 7 is a top view of a blank magazine of the present invention, wherein the blank magazine has been improperly provided with a single standard round; and FIG. 8 is a sectional view taken along Line 8—8 of FIG. 7; and FIG. 9 is a sectional view taken along Line 9—9 of FIG. 6; and FIG. 10 is a sectional view taken along Line 10—10 of FIG. 8; and FIG. 11 is a partially cut away sectional view of a firearm equipped with a blank magazine of the present invention, wherein the blank magazine improperly contains a standard round.

According to the present invention, there is provided a blank magazine for feeding blank rounds to a bolt-equipped firearm. The blank magazine has a back wall which has an inner surface. The blank magazine also has a front wall which has an inner surface and a top. The distance between the inner surface of the back wall and the inner surface of the front wall is less than the length of a standard round but is greater than the length of a blank round. The blank magazine of the present invention also has a structure which prevents any standard round from being fed by the bolt of the firearm to the chamber of the firearm.

Referring now to the drawings in general, and in particular to FIGS. 1 and 2, there is shown a blank magazine 20 of the present invention. The magazine 20 is especially adapted for feeding blank rounds to a firearm equipped with a bolt (see FIG. 11). The magazine 20 has a back wall 22 and a front wall 24.

Referring now to FIGS. 3 and 4, it can be seen that the magazine 20 of the present invention takes advantage of structural differences which are inherent in standard rounds and blank rounds. FIG. 3 shows a standard round 26 having a base 28, an extractor recess 30, a body 32, a shoulder 34, a neck 36 and a projectile 38. The length "S" of the standard round is measured from the bottom of the base 28 to the tip of the projectile 38. When the standard round 26 is used with an M-16 firearm, the standard round has a length of approximately 57.2 mm (2.25 inches). The neck of the standard round labeled "NSR" in FIG. 3 has a certain dimension.

Referring now to FIG. 4, there is shown a blank round 40. The blank round 40 is similarly equipped with a base 28', an extractor recess 30', a body 32', a shoulder 34' and a neck 36'. The neck 36' of the blank round labeled "NBR" in FIG. 4 is longer than the neck 36 of the standard round 26. Stated differently, NBR is greater than NSR. Naturally, the blank round 40 contains no projectile. The length "B" of the blank round 40 is less than the length "S" of the standard round 26. When the blank round 40 is intended for use in an M-16 rifle, the length "B" is approximately 35 mm (1.38 inches).

FIGS. 5 and 6, show enlarged views of the blank magazine 20 of the present invention. FIG. 5 is a view looking generally downwardly on FIG. 1 but with blank rounds 40,40' within the magazine 20.

The front wall 24 has a top 42 and an inner surface 44. The back wall 22 has an inner surface 46. The magazine 20 is equipped with a left side wall 48 joining the left side of the back wall 22 to the left side of the front wall 24. The top of the left side wall 48 terminates in a left cartridge-retaining lip 50.

The magazine 20 also has a right side wall 52 joining the right side of the back wall 22 to the right side of the front wall 24. Similarly, the top of the right side wall 52 terminates in a right cartridge-retaining lip 54.

The distance "D" between the inner surface 44 of the front wall 24 and the inner surface 46 of the back wall 22 is less than the length of a standard round ("S" in FIG. 3), but is greater than the length "B" of a blank round. This relationship prevents the magazine 20 from holding more than one standard round as explained more completely below.

Referring now to FIGS. 7 and 8, it can be seen that the magazine 20 of the present invention will accept only one standard round. As shown in FIGS. 7 and 8, a standard round 26 has been inserted into the magazine 20; however the top 42 of the front wall 24 supports the projectile 38 of the standard round 26. The cartridge-retaining lip 50 contacts the standard round 26 and holds its base 28 lower than the base 28' of a blank round 40, as shown in FIG. 5.

Within a magazine 20, the differing positions of a blank round 40 compared to that of a standard round 26 is most easily seen in FIGS. 9 and 10 respectively. In these figures, the circle 60 of radius "r" represents the outer dimensions of a bolt (not shown) (See FIG. 11.) FIG. 9, the circle 60 representing the bolt (not shown) overlaps the blank round 40 but as shown in FIG. 10 does not overlap the standard round 26. As explained more completely below, the differing positions of the bases of blank round 40 and the standard round 26 permits the bolt (not shown) to feed a blank round 40 but prevents the bolt (not shown) from feeding a standard round 26.

Referring now to FIG. 11, there are shown significant components of a firearm 62. The firearm 62 has a barrel 64 having a chamber 66 adapted to receive either a standard round 26 or a blank round 40. The firearm 62 has a bolt 68 of radius "r" which is circular in shape corresponding to the circle 60 shown in FIGS. 9 and 10. The bolt 68 is equipped with a right extractor 70 and a left extractor (not shown). The extractors, such as the extractor 70, cooperate with the extractor recess 30 to extract the cartridge 26 from the chamber 66. The firearm 62 is constructed along a centerline 72.

To feed a round from the magazine 20 to the chamber 66, the bolt 68 moves in the direction of the arrow 74 along the centerline 72. If the magazine 20 would contain a blank round as shown in FIG. 9, the bottom 76 of the bolt 68 would contact the blank round 40 moving the blank round 40 into the chamber 66. However, as shown in FIG. 11, when the magazine 20 contains a standard round 26 then the bottom 76 of the bolt 68 passes over the top of the standard round 26 with the result that the standard round 26 remains in the magazine 20 and is not fed to the chamber 66.

The magazine 20 of the present invention is optionally provided with a follower (not shown) and a spring (not shown) and other construction details, all of which are shown in Howard et al U.S. Pat. No. 4,139,959 issued Feb. 20, 1979, the entire disclosure of which is incorporated herein by reference.

The magazine 20 of the present invention can also be provided with a telescoping section as disclosed and claimed in Howard U.S. Pat. No. 4,472,900 issued Feb. 25, 1984.

The blank magazine 20 of the present invention can be constructed of metal, plastic, or other material, but is preferably constructed of plastic. A wide variety of plastics can be employed if they have the proper physical properties of strength, resilience, and toughness. Plastics such as polyesters, polyamides and polyolefins such as polyethylene or polypropylene, are potential candidates. The preferred material is a fiber-filled nylon sold by the Dupont Chemical Company under the tradename ZYTEL.

The blank magazine of the present invention can be used with all types of bolt-equipped firearms including pistols, rifles, and machine guns.

The blank magazine of the present invention can be used with a wide variety of blank rounds as long as the blank rounds are shorter than the corresponding standard round.

Although the invention has been described in considerable detail with reference to a preferred embodiment thereof, it will be apparent to those skilled in the art that the present invention can be modified without departing from the spirit and scope of the invention as described above and as defined in the appended claims.

What is claimed is:

1. A blank magazine for feeding blank rounds to the chamber of a bolt-equipped firearm; said magazine comprising:
   A. a back wall having an inner surface; and
   B. a front wall having an inner surface and a top;
   wherein the distance between the inner surface of the back wall and the inner surface of the front wall is less than the length of a standard round but is greater than the length of a blank round; and
   C. means for preventing any standard round from being fed by the bolt to the chamber of the firearm; and
   D. wherein said means constitutes means for holding the base of any standard round below the bolt such that an advancing bolt does not feed the standard round to the chamber; and
   E. wherein the blank round has an overall length that is less than the overall length of a standard round.

2. The magazine of claim 1, wherein the inner surface of the back wall is substantially parallel to the inner surface of the front wall.

3. The magazine of claim 1, wherein the blank rounds are shorter than the standard rounds.

4. The magazine of claim 1 constructed substantially completely of thermoplastic.

5. The magazine of claim 4, wherein the thermoplastic is nylon.

6. The magazine of claim 4, wherein the thermoplastic is polypropylene.

7. A magazine for holding a plurality of blank cartridges and for feeding these blank cartridges sequentially to a firearm having a bolt which cooperates with a chamber;
   wherein said magazine will receive only one standard round having a projectile; and will not permit that standard round to be fed to the chamber of the firearm; said magazine comprising:
   A. a front wall having a top and an inner surface; and
   B. a back wall having an inner surface; and
   C. a left side wall joining the left side of the back wall to the left side of the front wall; the top of said left side wall terminating in a left cartridge-retaining lip; and ,
   D. a right side wall joining the right side of the back wall to the right side of the front wall; the top of said right side wall terminating in a right cartridge-retaining lip; and
   wherein the distance between the inner surface of the front wall and the inner surface of the back wall is less than the length of a standard round but is greater than the length of a blank round; thereby preventing the magazine from holding more than one standard round; and wherein the top of the front wall supports the projectile of any standard round and wherein one cartridge-retaining lip contacts the standard round to hold the base of the standard round below the bottom of the bolt, thereby preventing the bolt from feeding the standard round to the chamber of the firearm; and wherein said magazine further comprises means for holding the base of any standard round below the bolt such that an advancing bolt does not feed the standard round to the chamber; and wherein the blank round has an overall length that is less than the overall length of a standard round.

8. A magazine for holding a plurality of blank rounds devoid of projectiles and for feeding these blank rounds sequentially to a firearm having a bolt which cooperates with a chamber;

wherein said magazine will receive only one projectile-containing round and will not permit that projectile-containing round to be fed to the chamber of the firearm; said magazine comprising:

A. a front wall having a top and an integral inner surface; and B. a back wall having an inner surface; and C. a left side wall fixedly joining the left side of the back wall to the left side of the front wall; the top of said left side wall terminating in a left cartridge-retaining lip; and D. a right side wall fixedly joining the right side of the back wall to the right side of the front wall; the top of said right side wall terminating in a right catridge-retaining lip; and wherein the distance between the inner surface of the front wall and the inner surface of the back wall is less than the length of a standard round but is greater than the length of a blank round; thereby constituting means for preventing the magazine from holding more than one projectile-containing round and wherein one cartridge-retaining lip contacts the projectile-containing round to hold the base of the projectile-containing round below the bottom of the bolt, thereby constituting means for preventing the bolt from feeding the projectile-containing round to the chamber of the firearm.

* * * * *